US006321978B1

(12) United States Patent
Tai

(10) Patent No.: US 6,321,978 B1
(45) Date of Patent: Nov. 27, 2001

(54) CARTON WITH AN ARCHED LID

(76) Inventor: Mu-San Tai, 13F, No.100, Sec.1, Wen Hua II Rd., Lin Kou Hsiang, Taipei Hsien (TW)

( * ) Notice: Subject to any disclaimer, the term of this patent is extended or adjusted under 35 U.S.C. 154(b) by 0 days.

(21) Appl. No.: 09/627,406

(22) Filed: Jul. 27, 2000

(51) Int. Cl.[7] ..... B65D 5/32
(52) U.S. Cl. ..... 229/122.24; 229/198.1
(58) Field of Search ..... 229/198.1, 199, 229/198.3, 198.2, 122.24; 220/4.28, 4.33, 252; 190/19, 20, 23, 34

(56) References Cited

U.S. PATENT DOCUMENTS

| | | | | |
|---|---|---|---|---|
| 117,625 | * | 8/1871 | Hanvey | 190/19 |
| 309,239 | * | 12/1884 | Mortimer et al. | 190/20 |
| 1,644,411 | * | 10/1927 | Bergstein | 229/198.2 |
| 2,345,350 | * | 3/1944 | Markwardt et al. | 229/122.23 |
| 2,497,979 | * | 2/1950 | Cole et al. | 190/24 |
| 3,487,991 | * | 1/1970 | Stern | 229/125.24 |
| 3,779,448 | * | 12/1973 | Wotten | 229/198.2 |
| 3,938,630 | * | 2/1976 | March | 190/19 |
| 4,102,557 | * | 7/1978 | Lee et al. | 220/4.33 X |
| 4,482,074 | * | 11/1984 | Lalley | 229/125.32 |
| 5,839,651 | * | 11/1998 | Teags et al. | 229/125.32 |
| 5,887,741 | * | 3/1999 | Chiang | 220/4.31 |

* cited by examiner

*Primary Examiner*—Stephen P. Garbe
*Assistant Examiner*—Tri M. Mai
(74) *Attorney, Agent, or Firm*—Bacon & Thomas PLLC

(57) ABSTRACT

The present invention relates to a carton with an arched lid. The carton structure includes a rectangular paperboard that can be folded to C-shape, a front wall and a rear wall positioned perpendicular to the C-shaped paperboard thus all construct a main body of the carton, and an arched lid. The invention is characterized in that a top wall is extended forwardly from the up side of the rear wall and two lateral arced walls are attached on two lateral sides of the top wall. One side of the two lateral arced walls is linear while the other side is arched with tooth-form pieces for being secured to the inner side of the top wall by screws and screw nuts thus an arched lid is formed.

2 Claims, 3 Drawing Sheets

CARTON WITH AN ARCHED LID

BACKGROUND OF THE INVENTION

1. Field of the Invention

The present invention relates to a carton with an arched top wall, especially to a carton with higher strength to withstand pressure during transport and with nicely appearance. Due to the delicate design, a lid on the top of a carton is arched for increasing the strength of anti-pressure. Through the combination of screws and screw nuts, the assembling process of cartons is simplified so that the labor is saving and manufacturing cost is reduced.

2. Description of the Prior Art

A conventional carton made of paperboard has the nature of easy assembling, light weight, foldaway feature for saving space. The higher thickness the paperboard is, the more strength the carton has. No matter the assembling way of the carton formed of a plurality pieces of paperboard is by glues or by staples, the main disadvantage of such kind of carton is that the carton is difficult to take apart once being assembled.

Furthermore, most of cartons are generally cubes or cuboids. The top of carton is flat thus often being placed something or as a seat for porters. Due to the pressure or being hit, a dent is formed in the surface of the carton so the appearance of the carton is affected. Thus the lower strength of the top of the carton is also a main fault.

Moreover, without special design, the conventional rectangular cartons are not so attractive and artistic in appearance. For exciting interest of users and increasing appeal of cartons, the design of cartons needs to be improved.

SUMMARY OF THE INVENTION

The primary object of the present invention is to provide a carton includes a 5-side main body formed by a plurality of paperboards (walls) and a top wall extending from the rear wall of the carton. Two lateral arced walls with tooth-form pieces on arched side thereof are secured to the inner side of the top wall by screws and screw nuts so that an arched lid is formed.

It is a further purpose of the present invention to provide lateral flaps on lateral side of each wall that forms the carton with holes thereon for the convenience of assembly and dismantling by screws.

BRIEF DESCRIPTION OF THE DRAWINGS

The invention will be best understood by reference to the following description taken in connection with the accompanying drawings.

DETAILED DESCRIPTION OF THE PREFERRED EMBODIMENT

Figure 1:
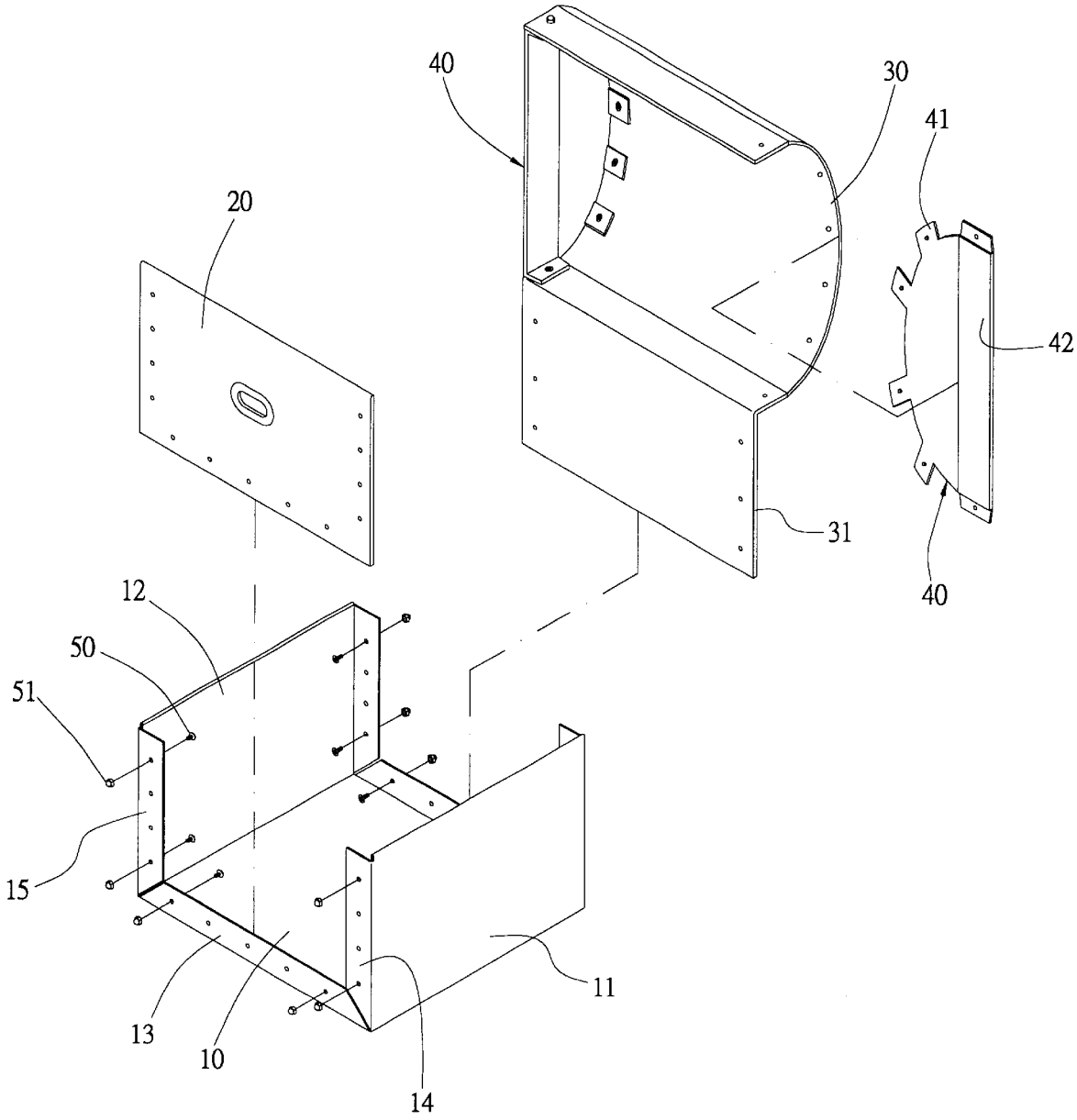
FIG. 1 shows an explosive view of the present invention.
Figure 2:
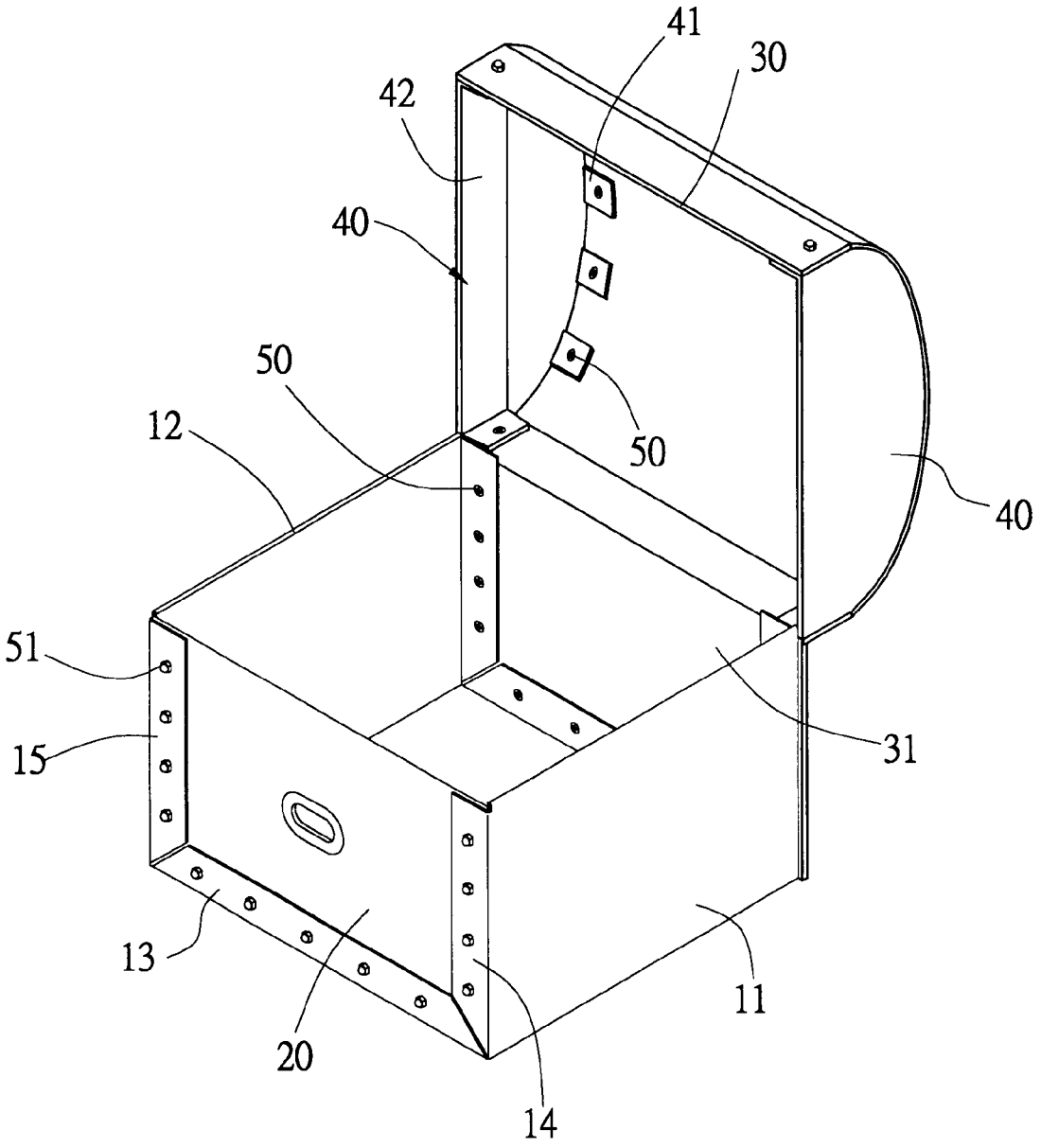
FIG. 2 shows an elevation view of the present invention when the lid of the device is open.
Figure 3:
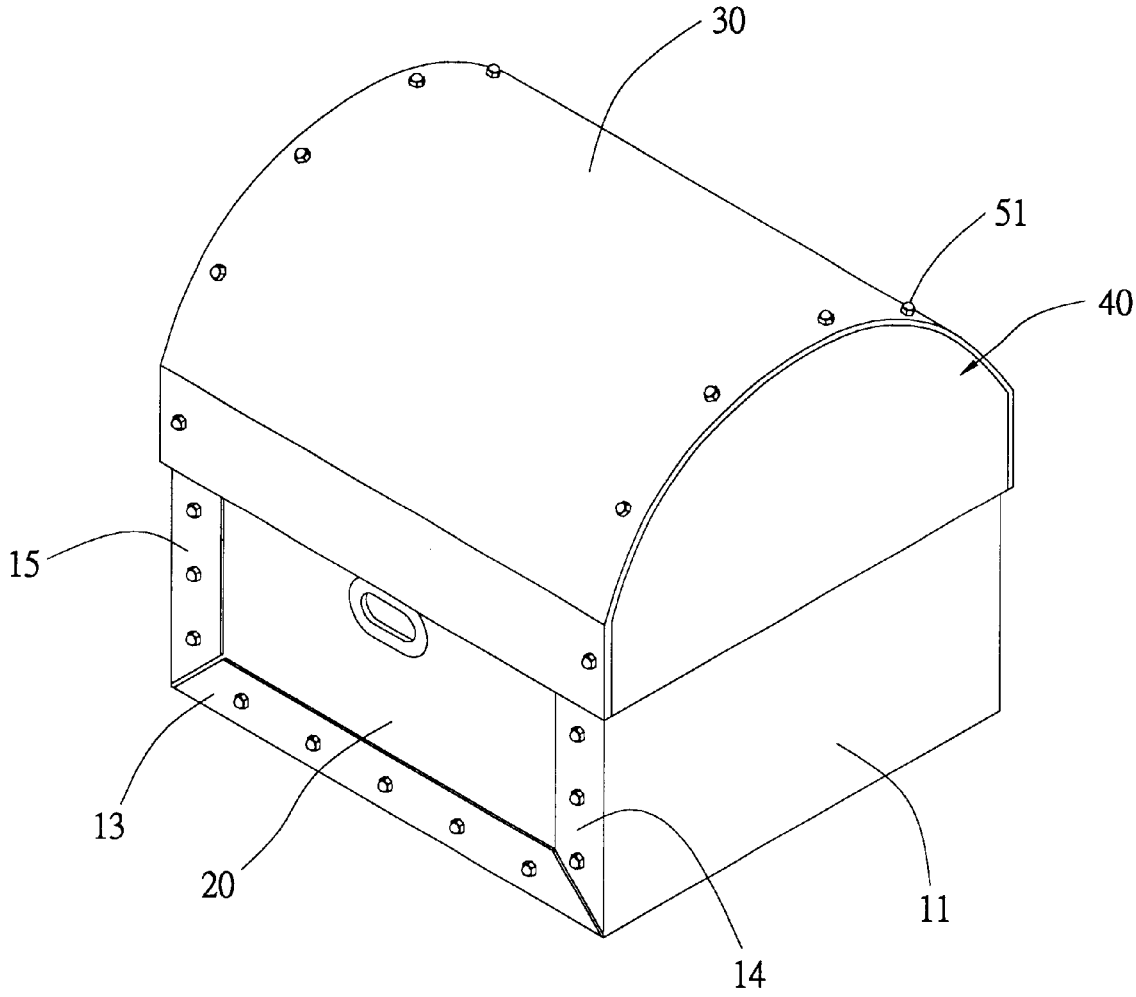
FIG. 3 is another embodiment of the present invention when the lid is closed.

Refer to FIG. 3, the present invention is a carton with an arched top wall 30. With reference of FIG. 1 and FIG. 2, a main body of the carton is a foldable rectangular paperboard.

After being folded to C-shape, a bottom wall 10 and two side walls 11, 12 are formed. Flaps 13, 14, 15 with holes are folded on the front side and rear side of the bottom wall 10 so as two side walls 11, 12. A front wall 20 and a rear wall 31 are fitted at the front and rear side of the main body and perpendicular to the bottom wall 10. A plurality of holes are disposed on the edges of the front wall 20 and the rear wall 31 and correspond to the holes on each flap 13, 14, 15. The rear 31 and front wall 20 is connected to the bottom wall 10 and two side walls 11, 12 by means of screws 50 that penetrate through the holes and then secured by the screw nuts 51 thus form a 5-side main body of the carton. The present invention is characterized in that: a top wall 30 is extended forwardly from the up side of the rear wall 31 and two lateral arced walls 40 are attached on two lateral sides of the top wall 30. A flap 42 is mounted on the linear side of the lateral arced wall 40 and folded inwardly for increasing the strength while a plurality of tooth-form pieces 41 are disposed on the arched side of the lateral arced wall 40. The tooth-form pieces 41 are folded and attached on the inner side of the top wall 30 and then are secured by screws 50 and screw nuts 51. Thus the top wall 30 is arched and forms a firm arched lid.

The advantages of the present invention are as following:

1. The arched top wall of the present invention can enhance the strength of cartons. This is the main improvement of the present invention.
2. Due to the combination of screws and screw nuts, the assembling and dismantling of cartons are more convenient. At the same time, the paperboards can be used repetitively.
3. The special design of the arched lid of cartons in combination with screw sets makes the appearance of the present invention more delicate.

Many changes and modifications in the above-described embodiments of the invention can, of course, be carried out without departing from the scope thereof. Accordingly, to promote the progress in science and the useful arts, the invention is disclosed and is intended to be limited only by the scope of the appended claim.

What is claimed is:

1. A carton with an arched lid, the carton comprising:

a rectangular paperboard folded into a C-shaped portion;

a front wall and a rear wall positioned perpendicular to the rectangular paperboard folded into the C-shaped portion to provide a main body of the carton;

an arched top wall extended forwardly from an upper side of said rear wall, and two lateral arched walls are attached on two lateral sides of the arched top wall;

a plurality of tooth-form pieces are disposed on arched portions of said lateral arched walls and adapted to be folded and attached on an inner side of said arched top wall; and the rectangular paperboard folded into the C-shaped portion is secured to the front and rear walls with screws and screw nuts.

2. The carton with an arched lid as claimed in claim 1, wherein a flap is arranged on a linear side of each said lateral arched walls and folded inwardly to increase strength thereof.

* * * * *